US005901407A

United States Patent [19]

Boomgaarden

[11] Patent Number: 5,901,407

[45] Date of Patent: May 11, 1999

[54] SCRUBBING MACHINE WITH MEANS FOR CONTINUOUSLY CLEANING A FILTER

[75] Inventor: Steven L. Boomgaarden, Rosemount, Minn.

[73] Assignee: Tennant Company, Minneapolis, Minn.

[21] Appl. No.: 08/856,787

[22] Filed: May 15, 1997

[51] Int. Cl.[6] ..... A47L 11/30

[52] U.S. Cl. ..... 15/320; 15/353; 210/411

[58] Field of Search ..... 210/410, 411; 15/320, 353, 321

[56] References Cited

U.S. PATENT DOCUMENTS

| | | | |
|---|---|---|---|
| 2,720,314 | 10/1955 | Booth | 210/410 |
| 3,996,640 | 12/1976 | Blue et al. . | |
| 4,377,017 | 3/1983 | Herpers et al. | 15/320 |
| 4,393,538 | 7/1983 | Olson | 15/320 |
| 4,464,810 | 8/1984 | Karpanty . | |
| 4,466,155 | 8/1984 | Grave . | |
| 4,586,208 | 5/1986 | Trevarthen . | |
| 4,696,075 | 9/1987 | Grave . | |
| 4,741,069 | 5/1988 | Helm et al. . | |
| 5,094,751 | 3/1992 | Ramsey et al. . | |
| 5,114,574 | 5/1992 | Barry . | |
| 5,331,713 | 7/1994 | Tipton . | |
| 5,462,678 | 10/1995 | Rosaen | 210/410 X |
| 5,589,080 | 12/1996 | Cho et al. | 15/320 X |

FOREIGN PATENT DOCUMENTS

WO85/02528 6/1985 WIPO .

*Primary Examiner*—Chris K. Moore

*Attorney, Agent, or Firm*—Dorn, McEachran, Jambor & Keating

[57] ABSTRACT

A surface scrubbing machine includes a body, wheels for supporting the body am& cylindrical scrub brushes mounted on the body for cleaning an adjacent surface. There is a clean water solution tank on the body for supplying a cleaning solution to the surface to be cleaned. A recovery tank is positioned on the body and there is a vacuum system for suctioning used cleaning solution from the surface being cleaned and for conveying it to the recovery tank. A filter is positioned in the recovery tank and there is a pump for transferring filtered solution from the downstream side of the filter to the clean water solution tank. A conduit extends from adjacent the downstream side of the filter to atmosphere and there is a solenoid for intermittently opening and closing the conduit to apply intermittent pressure against the downstream side of the filter to remove soilage from its upstream sides

8 Claims, 2 Drawing Sheets

SCRUBBING MACHINE WITH MEANS FOR CONTINUOUSLY CLEANING A FILTER

THE FIELD OF THE INVENTION

It is the present practice in large scrubbing machines of the type sold by Tennant Company, the assignee of the present application, and specifically its model 7400, to recycle the cleaning solution. This adds substantial time for continuous cleaning before the solution needs to be drained and replenished with fresh unused solution. As a part of the recycling system, the used cleaning solution which is vacuumed from the surface being cleaned into a recovery tank, is filtered and then transferred by a pump to the cleaning solution tank. Thus, the filter and the pump that transfers the filtered solution allow the cleaning solution to be recycled. After time, the filter in such a recycling system will become clogged, as the scrubbing machine normally picks up small debris and other particles which will tend to block the openings in the filter.

The present invention provides a means for periodically and intermittently cleaning the filter. This has the effect of essentially doubling the time that the machine may be used on a recycling basis before it is necessary to replace the cleaning solution.

The filter is cleaned by the application of air at atmospheric pressure which is directed against the downstream side of the filter. The pump which moves the filtered cleaning solution from the downstream side of the filter to the clean water solution tank normally operates on a suction basis. By placing a conduit directly adjacent the filter and by intermittently opening this conduit to air at atmospheric or ambient pressure, the soilage on the upstream side of the filter will be blow away from it, effectively removing such blockage from the filter.

The intermittent application of air at ambient pressure may be done while the pump continues to transfer filtered solution from the recovery tank to the solution tank. It has been found that a desirable cycle of operation is to have the application of air at ambient pressure for a period of approximately five seconds and then have no pressure applied for a period of approximately 45 seconds. This is done by the operation of a solenoid which will be controlled by a timer which may at times be overridden by an operator control.

SUMMARY OF THE INVENTION

The present invention relates to surface scrubbing machines, and in particular to such a machine which recycles its cleaning solution. A primary purpose of the invention is a scrubbing machine in which the cleaning solution is recycled and in which the filter is intermittently cleaned by the application of pressure applied to the downstream side of the filter.

Another purpose of the invention is a scrubbing machine as described in which the application of pressure to the downstream side of the filter is brought about by a conduit which is connected to ambient pressure or ambient air, with the conduit being opened and closed by the operation of a solenoid on a timed basis.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to surface maintenance machines, or scrubbers as they are commonly known, and the illustrated embodiment shows a scrubbing machine identified as the Tennant Model 7400 made by Tennant Company of Minneapolis, Minn., assignee of the present application. Such a machine conventionally recycles the cleaning solution and transfers it from the recovery tank a to the solution tank from which the solution is dispensed to a position adjacent the scrub brushes. In the alternative the invention may be used with a scrubbing machine in which the recovered fluid is transferred directly to a series of nozzles which spread the solution on the floor adjacent the cleaning brushes. The filter and the means for cleaning it are applicable to either type of machine.

Figure 1:
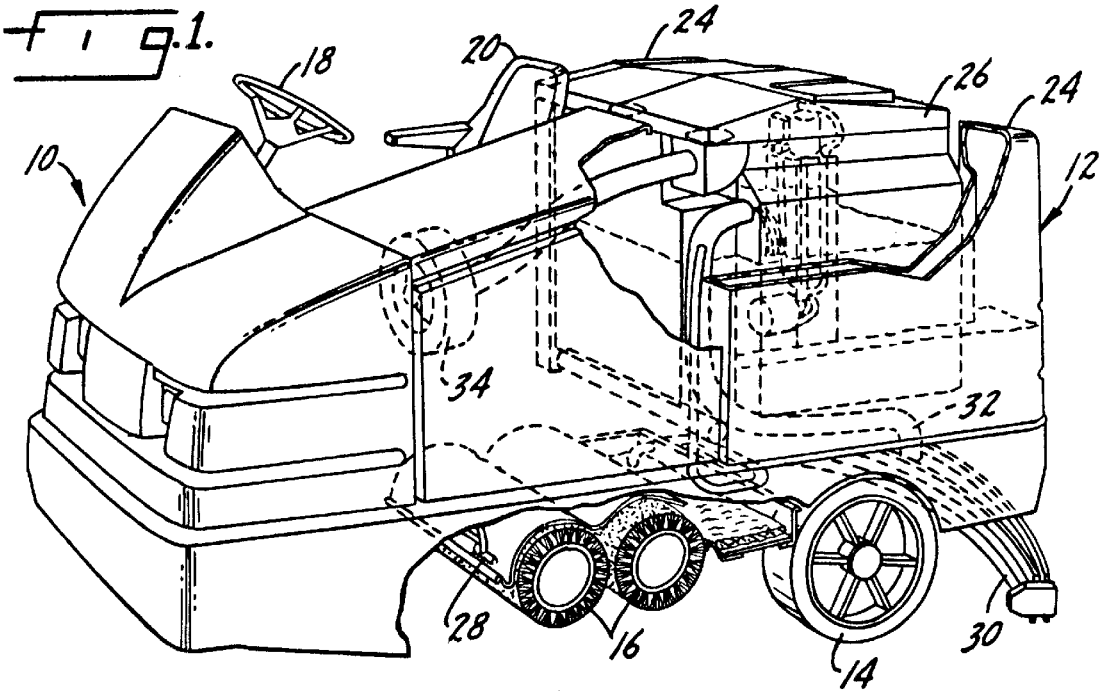
FIG. 1 is a perspective view of a scrubbing machine of the type disclosed herein.
Figure 2:
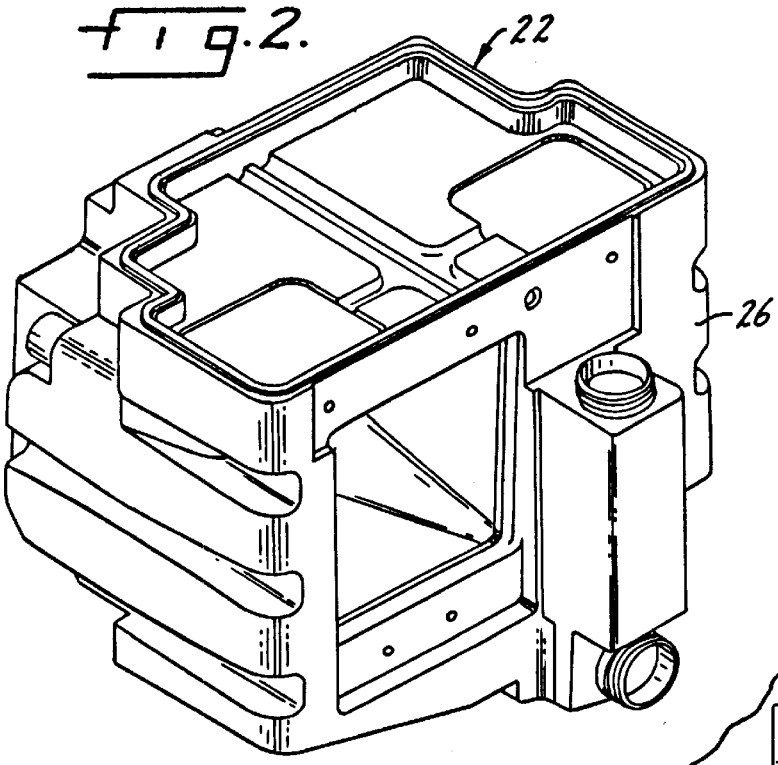
FIG. 2 is a perspective view of the scrubbing machine recovery tank.

As illustrated in FIG. 1, the machine 10 has a body 12*e* with the body being supported on wheels 14. There are a pair of adjacent and parallel cylindrical scrubbing brushes indicated at 16 which extend transverse to the direction of movement of the machine 10. The machine 10 has a steering wheel 15 and a seat 20 for the driver adjacent the steering wheel. The machine may be battery driven or it may be driven by other on-board self-propelling power.

As a part of the structure of the body 12, there is an enclosure 22 which may be formed of a suitable plastic and which includes a soiled water recovery tank 26. The cleaning solution will be distributed by a spray assembly 28 positioned directly in front of the front brush 160. After the surface has been scrubbed by the brushes, using the solution from the spray assembly 28, the solution will be recovered by a squeegee 30. Soiled cleaning solution contained by the squeegee 30 will be sucked up by a vacuum hose 32 and conveyed by the hose 32 to the recovery tank 26. The conduit 32 is part of a vacuum system, including a vacuum fan 34, which draws the soiled cleaning solution from the area adjacent the squeegee into the recovery tank.

Positioned within the recovery tank 26 is a filter 36 which may be cylindrical in form and is connected by a coupling 38 to a pump 40. The pump 40 will transfer filtered cleaning solution from the interior of filter 36, which is located in the recovery tank, through the pump and through a hose 42 to the clean water solution tank 24 Thus, in normal operation of a machine such as the Tenant Model 7400, the solution is recycled and such recycling extends the affective cleaning time of such a machine to as much as four hours before it is necessary to replace the cleaning solution.

The present invention provides a means for removing soilage from the upstream side or outside of the filter 36. Normally, the cylindrical brushes will aggressively clean the underlying surface upon which the machine is moving and dust, debris and other small particles will be drawn by the vacuum system into the recovery tank 26. Such particles will tend to clog the filter 36, limiting the time before such filter must be cleaned in order to remain effective.

Figure 3:
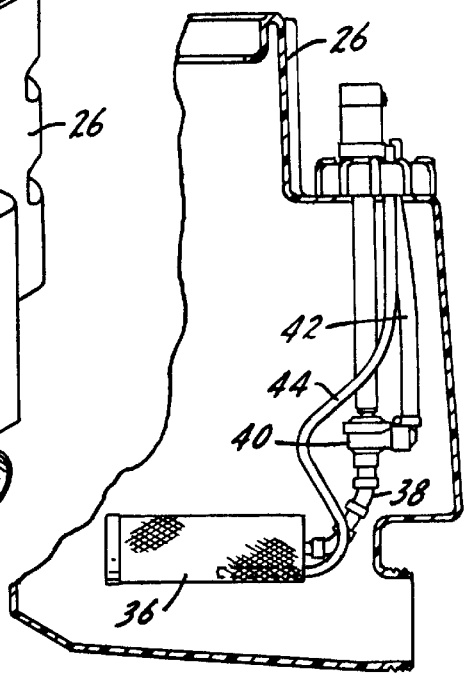
FIG. 3 is a partial vertical section illustrating the recovery tank and the filter and pump positioned therein.
Figure 4:
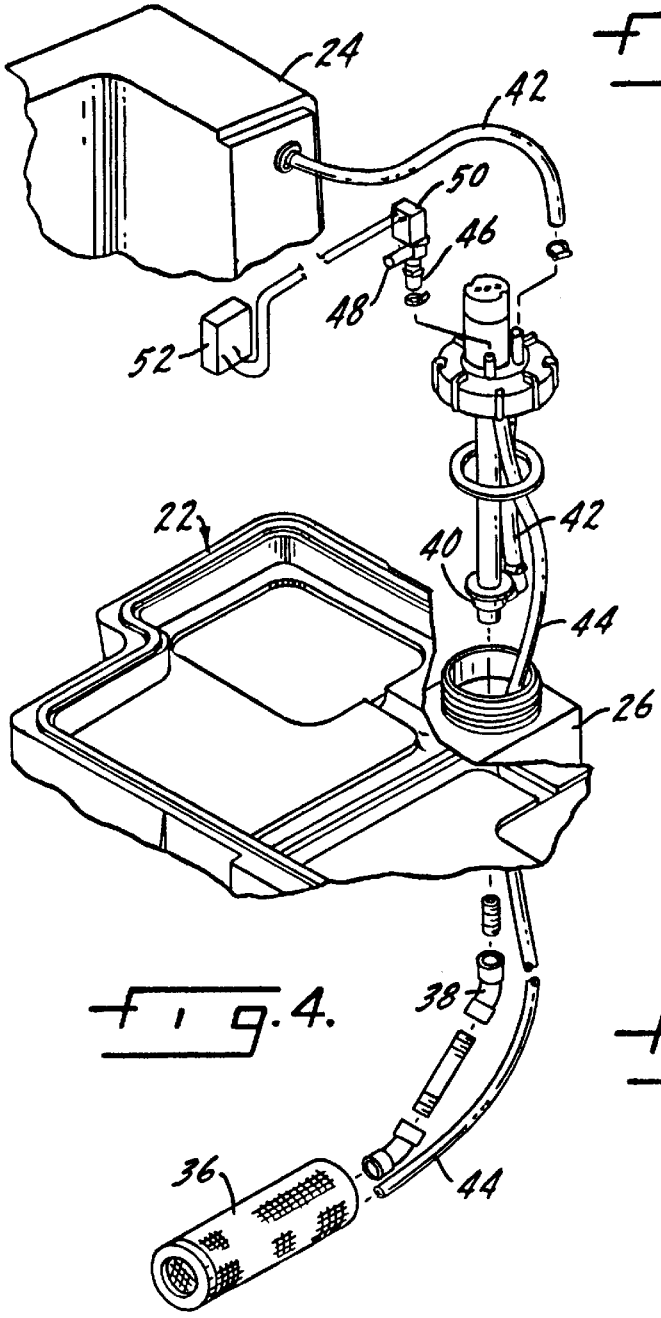
FIG. 4 is an exploded perspective illustrating the recovery tank, filter, pump for transferring fluid to the solution tank and a portion of the solution tank.
Figure 5:
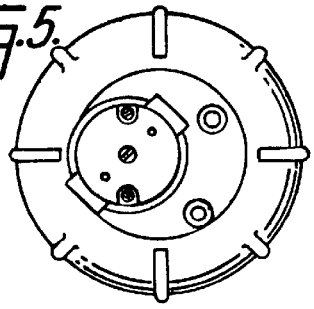
FIG. 5 is a top view of the pump and solenoid cap for controlling the application of air to clean the filter.
Figure 6:
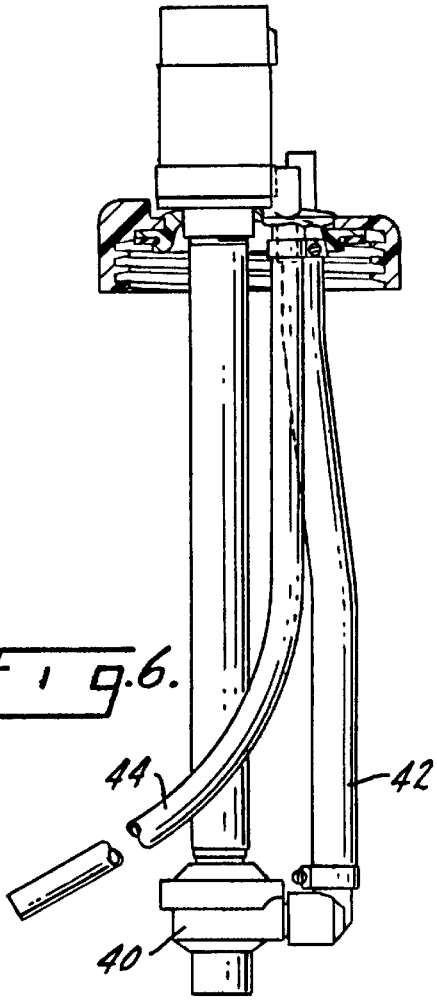
FIG. 6 is a side view of the pump, with the cap in section.
Figure 7:
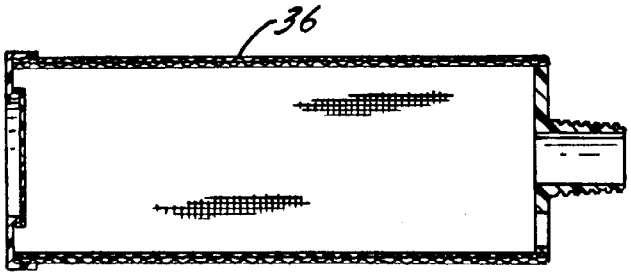
FIG. 7 is a side view of the filter in section.
Figure 8:
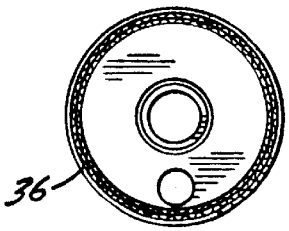
FIG. 8 is an end view of the filter.

The present invention provides a system for intermittently cleaning the filter 36. A conduit 44 extends into the interior of the filter, as shown in FIG. 3, and extends outside of the recovery tank to a fitting 46 attached at the top of the pump 40. There is an opening 48 in the fitting 46 which may be used to connect the conduit 44 to atmosphere or ambient pressure. Opening and closing of the connection between opening 48 and conduit 44 is controlled by solenoid 50 which is operated by means of a powered timer 52. When the solenoid 50 is activated, the opening 48 will be in communication with the interior of conduit 44*e* with the affect that air at atmospheric pressure will be applied into the interior of the filter 36. Since the vacuum fan 34 is maintaining the exterior of the filter at a negative pressure, the application of air at ambient or atmospheric pressure will direct a blast of air and water toward the downstream side of the cylindrical filter 36. This sudden, abrupt and intermittent application of pressure will tend to blow away particles which have clogged the openings in the filter 36. Thus, by the expedient and simple step of opening the area at the inside of the filter to a pressure above that of the liquid outside the filter, there will be a force applied to the downstream or interior or output side of the filter to the effect that debris clogged on the opposite side will be blown away.

The solenoid 50 may be operated on any suitable timed basis or it may be operator controlled. Preferably, it is operated on an intermittent basis, with the application of atmospheric pressure to the interior of the filter for a period of on the order of about five seconds followed by a period of normal operation without pressure for about 45 seconds. This has been shown to dramatically increase the length of time at which recycled fluid may be continuously used before it has to be changed. The invention should not be limited to any specific timed relationship between the application of pressure and normal operation, although the above has been shown to effectively double the machine operating time before the cleaning solution must be replaced.

The pump 40 will continue to function in a normal manner even during the time that air at ambient pressure is introduced into the filter. Thus, the pump may continuously function to recycle filtered cleaning solution even during the time that the filter is being cleaned.

Whereas the preferred form of the invention has been shown and described herein, it should be realized that there may be many modifications, substitutions and alterations thereto.

The embodiments of the invention in which an exclusive property or privilege is claimed are defined as follows:

1. A surface scrubbing machine including a body, wheels for supporting the body, surface scrubbing means mounted on the body, means mounted on the body for supplying a cleaning solution to a surface to be cleaned, a solution recovery tank on the body, vacuum means for suctioning used cleaning solution from the surface being cleaned and for conveying it to the recovery tank, a filter in the recovery tank, a pump for transferring filtered solution from the downstream side of the filter to the means for supplying a cleaning solution, and means for intermittently applying air at ambient pressure against the downstream side of said filter to remove soilage from the upstream side thereof.

2. The surface scrubbing machine of claim 1 wherein the means for applying air at ambient pressure includes a conduit extending from adjacent the downstream side of said filter to atmosphere.

3. The surface scrubbing machine of claim 2 including means for intermittently opening and closing said conduit.

4. The surface scrubbing machine of claim 3 wherein the means for intermittently opening and closing said conduit include an electrically operable solenoid.

5. The surface scrubbing machine of claim 4 wherein said solenoid is opened and closed on a uniformly timed basis.

6. The surface scrubbing machine of claim 3 wherein said filter is cylindrical, with said conduit extending into the interior of said filter.

7. The surface scrubbing machine of claim 1 wherein said means mounted on the body for supplying a cleaning solution to a surface to be cleaned include a solution tank mounted on the body, said pump transferring fluid from said recovery tank to said solution tank.

8. The surface scrubbing machine of claim 1 wherein said surface scrubbing means include a least one cylindrical scrubbing brush rotatably mounted beneath said body in a direction generally transverse to movement of the machine during a scrubbing operation.

* * * * *